US006786389B2

(12) United States Patent
Pursell

(10) Patent No.: US 6,786,389 B2
(45) Date of Patent: Sep. 7, 2004

(54) METHOD OF MANUFACTURING A FIBRE REINFORCED METAL COMPONENT

(75) Inventor: John G Pursell, Derby (GB)

(73) Assignee: Rolls-Royce plc, London (GB)

( * ) Notice: Subject to any disclaimer, the term of this patent is extended or adjusted under 35 U.S.C. 154(b) by 75 days.

(21) Appl. No.: 10/206,768

(22) Filed: Jul. 29, 2002

(65) Prior Publication Data

US 2003/0029904 A1 Feb. 13, 2003

(30) Foreign Application Priority Data

Aug. 11, 2001 (GB) ..... 0119636

(51) Int. Cl.[7] ..... B23K 31/02

(52) U.S. Cl. ..... 228/165; 228/180.5; 228/234.1; 228/246

(58) Field of Search ..... 228/165, 174, 228/180.5, 245, 246, 234.1; 29/889.7, 889.71, 889.2, 458, 530

(56) References Cited

U.S. PATENT DOCUMENTS

| | | | | | |
|---|---|---|---|---|---|
| 4,448,838 | A | * | 5/1984 | McClenahan et al. | 442/229 |
| 5,132,278 | A | * | 7/1992 | Stevens et al. | 505/231 |
| 5,260,124 | A | * | 11/1993 | Gaier | 442/219 |
| 5,427,304 | A | | 6/1995 | Woods | |
| 5,559,918 | A | * | 9/1996 | Furuyama et al. | 385/92 |
| 5,671,315 | A | * | 9/1997 | Tabuchi et al. | 385/137 |
| 5,946,801 | A | * | 9/1999 | Twigg et al. | 29/889.71 |

FOREIGN PATENT DOCUMENTS

| | | | | |
|---|---|---|---|---|
| EP | 0 831 154 | A | | 3/1998 |
| GB | 2 168 032 | A | | 6/1986 |
| GB | 2 198 675 | A | | 6/1988 |
| JP | 02002169067 | A | * | 6/2002 |
| WO | PCT/US00/11574 | A | | 11/2000 |

OTHER PUBLICATIONS

US 2002/0029904A1 Pursell (Feb. 13, 2002).*

* cited by examiner

*Primary Examiner*—Kiley Stoner
(74) *Attorney, Agent, or Firm*—W. Warren Taltavull; Manelli, Denison & Selter PLLC

(57) ABSTRACT

A method of manufacturing a fiber reinforced metal disc comprises forming an annular groove in an axial face of a first metallic ring. A plurality of metal coated fibers are arranged in spiral preforms and a plurality of metallic wires are arranged in spiral preforms. The metal coated fiber preforms and the metallic wire preforms are arranged in the groove. An annular projection is formed on an axial face of a second metallic ring. The annular projection on the second metallic ring is aligned with the annular groove in the first metallic ring. Heat and pressure is applied to axially consolidate the metal coated fiber preforms and metallic wire preforms and to bond the first metal ring, the second metal ring, and the preforms to form a unitary composite disc. The use of metal coated fibers and metallic wires allows the mechanical properties to be tailored.

12 Claims, 4 Drawing Sheets

METHOD OF MANUFACTURING A FIBRE REINFORCED METAL COMPONENT

FIELD OF THE INVENTION

The present invention relates to a method of manufacturing a fibre reinforced metal cylinder, in particular to a method of manufacturing a fibre reinforced metal ring or a fibre reinforced metal disc.

BACKGROUND OF THE INVENTION

In one known method of manufacturing a fibre reinforced metal ring, as disclosed in UK patent application No. GB2168032A, a fibre is wound spirally in a plane with a metal matrix spiral between the turns of the fibre spiral. The fibre spiral and metal matrix spiral are positioned between discs of metal matrix and this arrangement is pressed axially to consolidate the ring structure. This produces little or no breaking of the fibres.

A problem with this method is that it is difficult to wind the fibre and metal matrix unless the fibre and metal matrix have the same diameter. If the fibre and metal matrix wire have the same diameter the ring structure has a low volume fraction of fibre.

In another known method of manufacturing a fibre reinforced metal ring, as disclosed in UK patent application No. GB2198675A, a continuous helical tape of fibres and a continuous helical tape of metal foil are interleaved. The interleaved helical tapes of fibres and the metal foil are placed in an annular groove in a metal member and a metal ring is placed on top of the interleaved helical tapes of fibres and metal foil. The metal ring is pressed axially to consolidate the assembly and to diffusion bond the metal ring, the metal member and the interleaved helical tapes of fibres and metal foil together to form an integral structure. This method produces little or no breaking of the fibres.

In a further known method of manufacturing a fibre reinforced metal ring, as disclosed in our European patent No. EP0831154B1, a plurality of metal coated fibres are placed in an annular groove in a metal member and a metal ring is placed on top of the metal coated fibres. Each of the metal coated fibres is wound spirally in a plane and the metal coated fibre spirals are stacked in the annular groove in the metal member. The metal ring is pressed axially to consolidate the assembly and to diffusion bond the metal ring, the metal member and the metal coated fibre spirals together to form an integral structure. This method produces little or no breaking of the fibres.

The latter method suffers from several problems. Firstly the method of coating the fibres with metal may be costly. Secondly the choice of metals, or alloys, which may be coated onto the fibres is limited. Thirdly the fibre arrangement produced by the method is always the same and hence this limits the ability of the designer to tailor the properties of hoop strength, axial strength and radial strength to optimum for any particular fibre reinforced metal disc or fibre reinforced metal ring.

SUMMARY OF THE INVENTION

Accordingly the present invention seeks to provide a novel method of manufacturing a fibre reinforced metal component.

Accordingly the present invention provides a method of manufacturing a fibre reinforced metal component comprising the steps of:—

(a) forming a longitudinally extending groove in a face of a first metallic member, (b) arranging at least one longitudinally extending metal coated fibre and at least one longitudinally extending metallic wire in the longitudinally extending groove in the first metallic member, (c) forming a longitudinally extending projection on a face of a second metallic member, (d) arranging the second metallic member such that the longitudinally extending projection of the second metallic member is aligned with the longitudinally extending groove of the first metallic member, (e) applying heat and pressure such that the longitudinally extending projection moves into the longitudinally extending groove to consolidate the at least one longitudinally extending metal coated fibre and the at least one longitudinally extending metallic wire and to bond the first metallic member, the second metallic member, the at least one longitudinally extending metal coated fibre and the at least one longitudinally extending metallic wire to form a unitary composite component.

The method preferably comprises forming a circumferentially extending groove in an axial face of the first metallic member, arranging the at least one circumferentially extending metal coated fibre and at least one circumferentially extending metallic wire in the circumferentially extending groove in the first metallic member, forming a circumferentially extending projection on a face of the second metallic member, arranging the second metallic member such that the circumferentially extending projection of the second metallic member is aligned with the circumferentially extending groove of the first metallic member, applying heat and pressure such that the circumferentially extending projection moves into the circumferentially extending groove to consolidate the at least one circumferentially extending metal coated fibre and the circumferentially extending metallic wire and to bond the first metallic member, the second metallic member, the at least one circumferentially extending metal coated fibre and the circumferentially extending metallic wire to form a unitary composite component.

The method may comprise arranging the at least one circumferentially extending metal coated fibre and the at least one circumferentially extending metallic wire in the circumferentially extending groove in the first metallic member such that the at least one circumferentially extending metal coated fibre and the at least one circumferentially extending metallic wire are arranged in a common plane.

The method may comprise arranging the at least one circumferentially extending metallic wire at a greater radial distance than the at least one circumferentially extending metal coated fibre.

The method may comprise arranging the at least one circumferentially extending metal coated fibre and the at least one circumferentially extending metallic wire in the circumferentially extending groove in the first metallic member such that the at least one circumferentially extending metal coated fibre and the at least one circumferentially extending metallic wire are arranged in different planes.

Preferably the method comprises arranging a plurality of circumferentially extending metal coated fibres and a plurality of circumferentially extending metallic wires in the circumferentially extending groove in the first metallic member.

The method may comprise arranging the plurality of circumferentially extending metal coated fibres and the plurality of circumferentially extending metallic wires in the circumferentially extending groove in the first metallic member such that a first one of the plurality of circumferentially extending metal coated fibres and a first one of the plurality of circumferentially extending metallic wires are arranged in a first common plane, a second one of the plurality of circumferentially extending metal coated fibres and a second one of the plurality of circumferentially extending metallic wires are arranged in a second common plane and the first and second common planes are spaced apart axially of the first metallic member.

DESCRIPTION OF THE DRAWINGS

The present invention will be more fully described by way of example with reference to the accompanying drawings, in which:—

DESCRIPTION OF THE INVENTION

Figure 1:
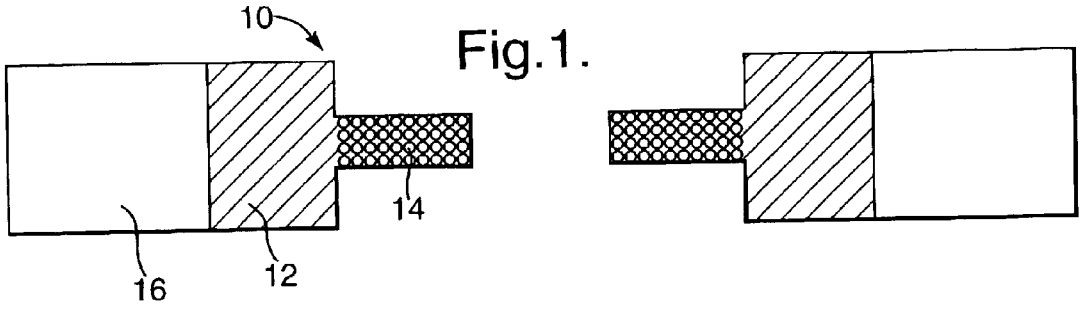
FIG. 1 shows a longitudinal cross-sectional view through a bladed compressor rotor made according to the method of the present invention.

A finished ceramic fibre reinforced metal rotor 10 with integral rotor blades is shown in FIG. 1. The rotor 10 comprises a metal ring 12 which includes a ring of circumferentially extending reinforcing ceramic fibres 14, which are fully diffusion bonded to the metal ring 12. A plurality of equi-circumferentially spaced solid metal rotor blades 16 extend radially outwardly from and are integral with the metal ring 12.

The ceramic fibre reinforced metal rotor 10 is manufactured using a plurality of metal coated ceramic fibres and a plurality of metal matrix wires. Each ceramic fibre 14 is coated with metal matrix 18 by any suitable method, for example physical vapour deposition, sputtering etc. A first set 20A of metal coated 18 ceramic fibre 14 are arranged to have a first length. A second set 20B of metal coated 18 ceramic fibre 14 are arranged to have a second length which is longer than the first length.

Figure 2:
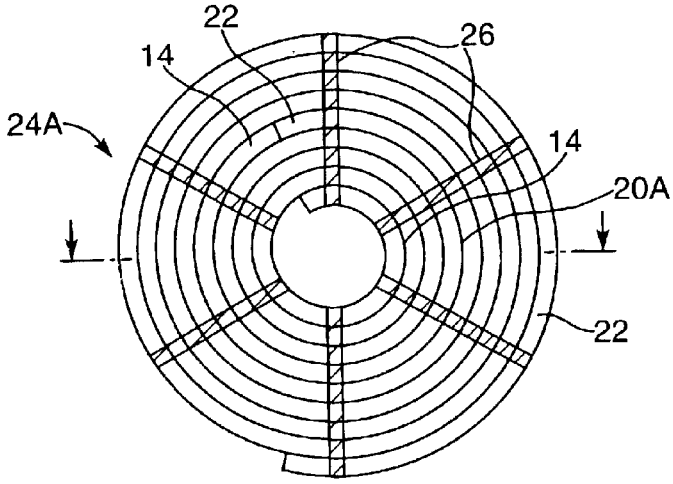
FIG. 2 is a plan view of a metal coated fibre preform and a metal matrix preform used in the method of the present invention.
Figure 3:
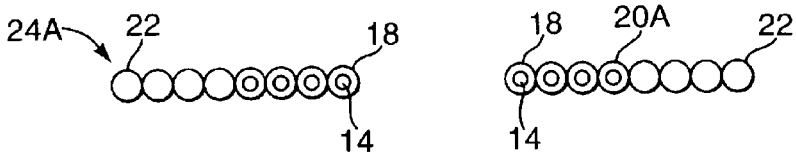
FIG. 3 is a cross-sectional view through the metal coated fibre preform and the metal matrix preform shown in FIG. 2.

Each of the metal coated ceramic fibres 14 of the first set 20A is wound around a mandrel. A metal matrix wire 22 is then wound coaxially around each metal ceramic fibre 14 of the first set 20A to form an annular disc shaped preform 24A as shown in FIGS. 2 and 3. Each annular, or disc shaped, preform 24A thus comprises a single metal coated 18 ceramic fibre 14 arranged in a spiral and a single metal matrix wire 22 arranged coaxially in a spiral with the metal matrix wire 22 arranged at a greater diameter than the metal coated 18 ceramic fibre 14. A glue 26 is applied to the annular, or disc shaped, preform 24A at suitable positions to hold the turns of the spirals together.

Figure 4:
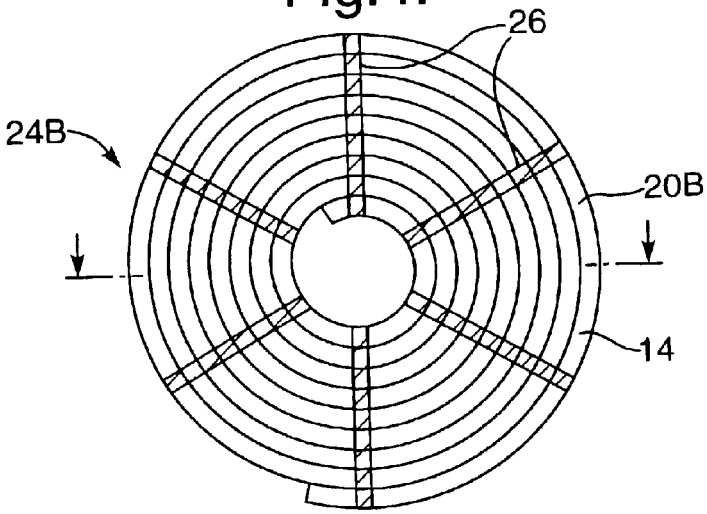
FIG. 4 is a plan view of a metal coated fibre preform used in the method of the present invention.
Figure 5:
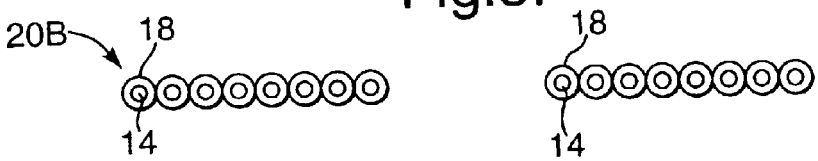
FIG. 5 is a cross-sectional view through the metal coated fibre preform shown in FIG. 4.

Each of the metal coated ceramic fibres 14 of the second set 20B is wound around a mandrel to form an annular, or disc shaped fibre preform 24B as shown in FIGS. 4 and 5. Each annular, or disc shaped, preform 24B thus comprises a single metal coated 18 ceramic fibre 14 arranged in a spiral. A glue 26 is applied to the annular, or disc shaped, preform 24B at suitable positions to hold the turns of the spirals together.

The glue is selected such that it may be completely removed from the annular, or disc shaped, preforms 24A and 24B prior to consolidation. The glue may be for example polymethyl-methacrylate in di-chloromethane or perspex in di-chloromethane.

Figure 8:
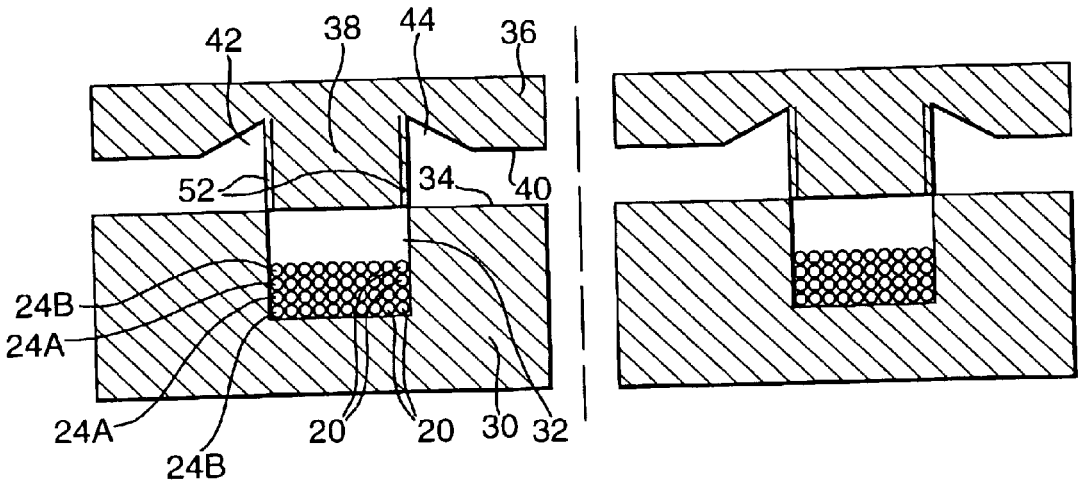
FIG. 8 is a longitudinal cross-sectional view through an assembly of fibre preforms and metal matrix preforms positioned between first and second metallic members.

A first annular ring, or metal disc, 30 is formed and an annular axially extending groove 32 is machined in one axial face 34 of the first metal ring 30, as shown in FIG. 8. The annular groove 32 has straight parallel sides, which form a rectangular cross-section. A second metal ring, or a metal disc, 36 is formed and an annular axially extending projection 38 is machined from the second metal ring 36 such that it extends from one axial face 40 of the second metal ring 36. The second metal ring 30 is also machined to form two annular grooves 42 and 44 in the face 40 of the second metal ring 36. The annular grooves 42 and 44 are arranged radially on opposite sides of the annular projection 38 and the annular grooves 42 and 44 are tapered radially from the axial face 40 to the base of the annular projection 38. It is to be noted that the radially inner and outer dimensions, diameters, of the annular projection 38 are substantially the same as the radially inner and outer dimensions, diameters, of the annular groove 32.

One or more annular preforms 24A and one or more annular preforms 24B are positioned coaxially in the annular groove 32 in the axial face 34 of the first metal ring 30. The radially inner and outer dimensions, diameters, of the annular preforms 24A and 24B are substantially the same as the radially inner and outer dimensions, diameters, of the annular groove 32 to allow the annular preforms 24A and 24B to be loaded into the annular groove 32 while substantially filling the annular groove 32. A sufficient number of annular preforms 24A and 24B are stacked one upon the other in a predetermined arrangement in the annular groove 32 to partially fill the annular groove 32 to a predetermined level.

The second metal ring 36 is then arranged such that the axial face 40 confronts the axial face 34 of the first metal ring 30 and the axes of the first and second metal rings 30 and 36 are aligned such that the annular projection 38 on the second metal ring 36 aligns with the annular groove 32 in the first metal ring 30. The second metal ring 36 is then pushed towards the first metal ring 30 such that the annular projection 38 enters the annular groove 32 and is further pushed until the axial face 40 of the second metal ring 36 abuts the axial face 34 of the first metal ring 30.

The radially inner and outer peripheries of the axial face 34 of the first metal ring 30 are sealed to the radially inner and outer peripheries respectively of the axial face 40 of the second metal ring 36 to form a sealed assembly. The sealing is preferably by TIG welding, electron beam welding, laser welding or other suitable welding processes to form an inner annular weld seal and an outer annular weld seal.

The sealed assembly is evacuated using a vacuum pump and pipe connected to the chambers 42 or 44. The sealed assembly is then heated, while being continuously evacuated to evaporate the glue from the annular preforms 24A and 24B and to remove the glue from the sealed assembly.

After all the glue has been removed from the annular preforms 24A and 24B and the interior of the sealed assembly is evacuated the pipe is sealed. The sealed assembly is then heated to diffusion bonding temperature and isostatic pressure is applied to the sealed assembly, this is known as hot isostatic pressing. This results in axial consolidation of the annular preforms 24A and 24B and diffusion bonding of the first metal ring 30 to the second metal ring 36 and diffusion bonding of the metal on the metal coated 18 ceramic fibres 14 to the metal on other metal coated 18 ceramic fibres 14 to the first metal ring 30, the second metal ring 36 and to the metal matrix wire 22. During the hot isostatic pressing the pressure acts equally from all directions on the sealed assembly, and this causes the annular projection 38 to move axially into the annular groove 32 to consolidate the annular preforms 24A and 24B.

Figure 9:
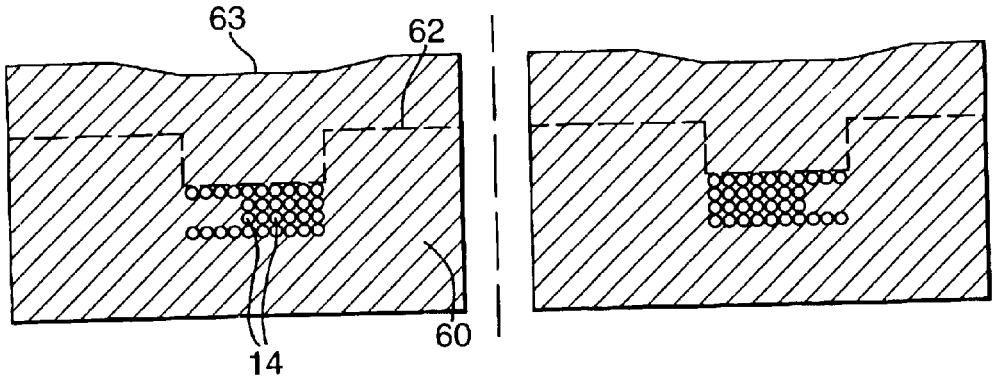
FIG. 9 is a longitudinal cross-sectional view through an assembly of fibre preforms and metal matrix preforms positioned between first and second metallic members after consolidation and bonding to form a unitary composite structure.
Figure 10:
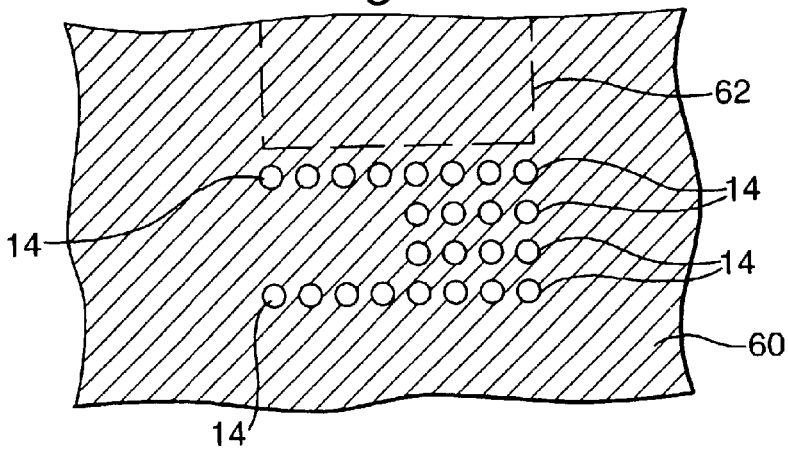
FIG. 10 is an enlarged longitudinal cross-sectional view of part of FIG. 9 showing the fibres.

The resulting consolidated and diffusion bonded ceramic fibre reinforced component 60 is shown in FIGS. 9 and 10, which shows the ceramic fibres 14 and the diffusion bond region 62. Additionally the provision of the grooves, or chambers 42 and 44 allows the annular projection 38 to move during the consolidation process and in so doing this results in the formation of a recess 63 in the surface of what was the second metal ring. The recess 63 indicates that successful consolidation and diffusion bonding has occurred.

After consolidation and diffusion bonding the component is machined to remove at least a portion of what was originally the second metal ring and at least a portion of the diffusion bonded region.

The component may then be machined for example by electrochemical machining or milling to form the integral compressor blades or the component may be machined to form one or more slots to receive the roots of compressor blades. Alternatively compressor blades may be friction welded, laser welded or electron beam welded onto the component.

The length of the metal coated 18 ceramic fibres 14 and the length of the metal matrix wires 22 in the annular preforms 24A may be preselected so as to obtain fibre reinforcement at the appropriate diameters in the component. Additionally it may be possible to wind the metal matrix wire 22 around the mandrel first and then to wind the metal coated ceramic fibre 14 coaxially around the metal matrix wire 22 so as to obtain fibre reinforcement at the appropriate diameters in the component. Furthermore, it may be possible to have two or more predetermined lengths of metal coated ceramic fibre and two or more predetermined lengths of metal matrix wire sequentially wound coaxially around each other in a common plane.

Figure 11:
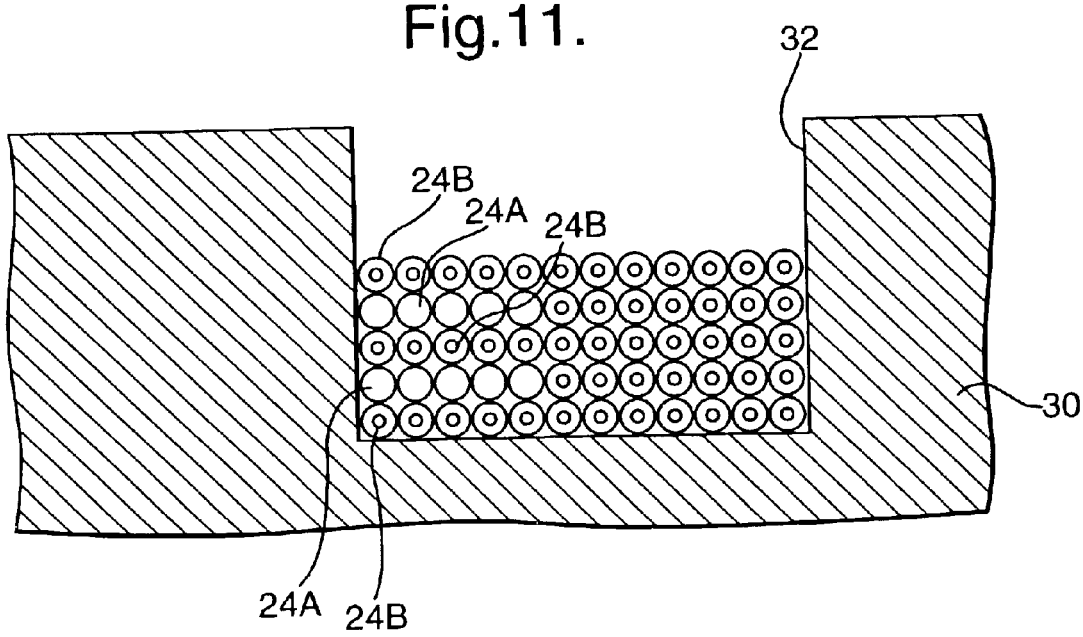
FIG. 11 is an enlarged longitudinal cross-sectional through part of an assembly of fibre preforms and metal matrix preforms positioned between first and second metallic members showing one stacking arrangement of preforms.

In FIG. 8, there are two preforms 24A between two preforms 24A to provide less ceramic fibre reinforcement in the central area at the outer diameter region as shown in FIG. 10. The preforms 24A and 24B may be stacked in any predetermined arrangement. The preforms 24A and 24B may be arranged alternately, as shown in FIG. 11, or there may a plurality of preforms 24A between adjacent preforms 24B or a plurality of preforms 24B between adjacent preforms 24A or there may a combination of any of these in the stack of preforms 24A and 24B.

In an alternative embodiment the ceramic fibre reinforced metal rotor 10 is manufactured using a plurality of metal coated ceramic fibres and a plurality of metal matrix wires.

Each ceramic fibre 14 is coated with metal matrix 18 by any suitable method, for example physical vapour deposition, sputtering etc. The metal coated 18 ceramic fibres 14 are arranged to have a predetermined length. Each of the metal coated ceramic fibres 14 is wound around a mandrel to form an annular, or disc shaped fibre preform 24B as shown in FIGS. 4 and 5. Each annular, or disc shaped, preform 24B thus comprises a single metal coated 18 ceramic fibre 14 arranged in a spiral. A glue 26 is applied to the annular, or disc shaped, preform 24B at suitable positions to hold the turns of the spirals together.

Figure 6:
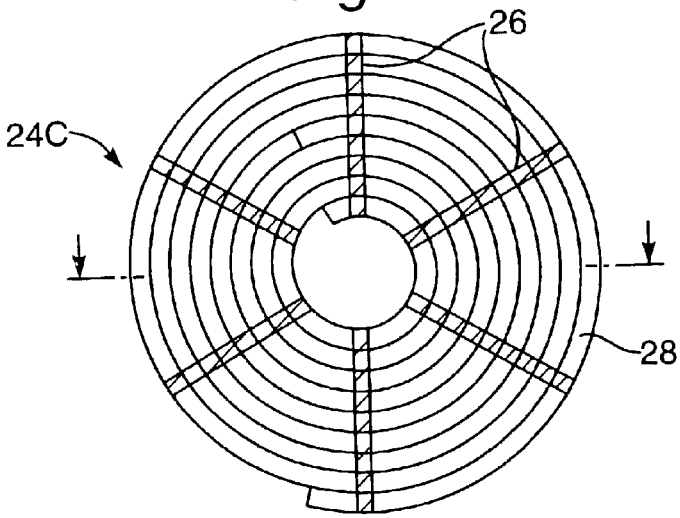
FIG. 6 is a plan view of a metal matrix preform used in the method of the present invention.
Figure 7:
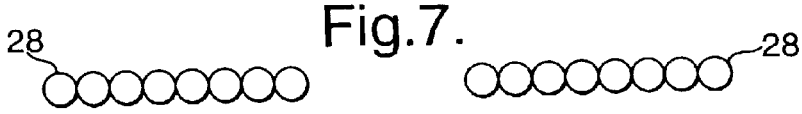
FIG. 7 is a cross-sectional view through the metal matrix preform shown in FIG. 6.

The metal matrix wires 28 are arranged to have a predetermined length. Each of the metal matrix wires 28 is wound around a mandrel to form an annular, or disc shaped preform 24C as shown in FIGS. 6 and 7. Each annular, or disc shaped, preform 24C thus comprises a single metal matrix wire 28 arranged in a spiral. A glue 26 is applied to the annular, or disc shaped, preform 24C at suitable positions to hold the turns of the spirals together.

Figure 12:
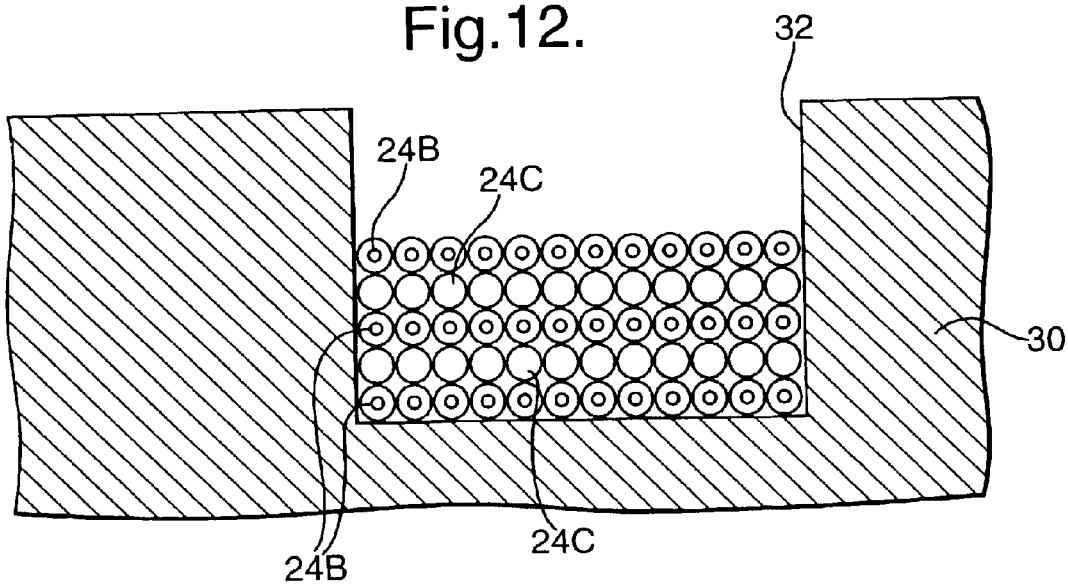
FIG. 12 is an enlarged longitudinal cross-sectional Through part of an assembly of fibre preforms and metal matrix preforms positioned between first and second metallic members showing an alternative stacking arrangement of preforms.

In this embodiment one or more annular preforms 24B and one or more annular preforms 24C are positioned coaxially in the annular groove 32 in the axial face 34 of the first metal ring 30, as shown in FIG. 12. The radially inner and outer dimensions, diameters, of the annular preforms 24B and 24C are substantially the same as the radially inner and outer dimensions, diameters, of the annular groove 32 to allow the annular preforms 24B and 24C to be loaded into the annular groove 32 while substantially filling the annular groove 32. A sufficient number of annular preforms 24B and 24C are stacked one upon the other in a predetermined arrangement in the annular groove 32 to partially fill the annular groove 32 to a predetermined level.

The preforms 24B and 24C are arranged alternately, as shown in FIG. 12. However, the preforms 24B and 24C may be stacked in any predetermined arrangement. There may be a plurality of preforms 24B between adjacent preforms 24C or a plurality of preforms 24C between adjacent preforms 24B or there may a combination of any of these in the stack of preforms 24B and 24C.

The diameter of the metal matrix wire 28 of the annular preforms 24C may the same diameter, or a different diameter to the diameter of the metal coated 18 ceramic fibres 14 of the annular preforms 24B.

The annular preforms 24C may also comprise two or more metal matrix wires having different diameter wound together around a mandrel. The annular preforms 24A may also comprise one or more metal matrix fibres and one or more metal matrix wires having different diameters wound together around a mandrel.

The reinforcing fibre may comprise alumina, silicon carbide, silicon nitride, boron, or other suitable fibre.

The metal coating on the ceramic fibre may comprise titanium, titanium aluminide, an alloy of titanium or any other suitable metal, alloy or intermetallic which is capable of being bonded.

The metal matrix wire may comprise titanium, titanium aluminide, an alloy of titanium or any other suitable metal, alloy or intermetallic which is capable of being bonded.

The first metal ring and the second metal ring comprise titanium, titanium aluminide, an alloy of titanium or any other suitable metal, alloy or intermetallic which is capable of being bonded.

The present invention has enables the ceramic fibre reinforced metal component to be produced at a lower cost by using metal matrix wires and metal coated ceramic fibres. The use of metal matrix wires enables the amount of metal to be deposited on the metal coated ceramic fibres to be reduced and hence reduces the cost of depositing metal onto the ceramic fibres.

The present invention allows different metals, or alloys to be used for the metal matrix wires and the metal coating on the ceramic fibres.

The present invention allows the radial strength of the ceramic fibre reinforced component to be improved without limiting hoop strength.

Thus each spirally wound metal coated ceramic fibre preform is arranged in a different, parallel, plane to the spirally wound metal matrix wire or some of the spirally wound metal coated ceramic fibre preforms are arranged in the same plane as the spirally wound metal matrix wire.

I claim:

1. A method of manufacturing a fibre reinforced metal component comprising the steps of:

(a) forming a longitudinally extending groove in a face of a first metallic member, (b) arranging at least one longitudinally extending metal coated fibre and at least one longitudinally extending metallic wire in the longitudinally extending groove in the first metallic member, (c) forming a longitudinally extending protection on a face of a second metallic member, (d) arranging the second metallic member such that the longitudinally extending protection of the second metallic member is aligned with the longitudinally extending groove of the first metallic member, (e) applying heat and pressure such that the longitudinally extending projection moves into the longitudinally extending groove to consolidate the at least one longitudinally extending metal coated fibre and the at least one longitudinally extending metallic wire and to bond the first metallic member, the second metallic member, the at least one longitudinally extending metal coated fibre and the at least one longitudinally extending metallic wire to form a unitary composite component, the method further comprising forming a circumferentially extending groove in an axial face of the first metallic member, arranging the at least one circumferentially extending metal coated fibre and at least one circumferentially extending metallic wire in the circumferentially extending groove in the first metallic member, forming a circumferentially extending projection on a face of the second metallic member, arranging the second metallic member such that the circumferentially extending protection of the second metallic member is aligned with the circumferentially extending groove of the first metallic member, applying heat and pressure such that the circumferentially extending protection moves into the circumferentially extending groove to consolidate the at least one circumferentially extending metal coated fibre and the circumferentially extending metallic wire and to bond the first metallic member, the second metallic member, the at least one circumferentially extending metal coated fibre and the circumferentially extending metallic wire to form a unitary composite component and arranging the at least one circumferentially extending metal coated fibre and the at least one circumferentially extending metallic wire in the circumferentially extending groove in the first metallic member such that the at least one circumferentially extending metal coated fibre and the at least one circumferentially extending metallic wire are arranged in a common plane.

2. A method of manufacturing a fibre reinforced metal component comprising the steps of:

(a) forming a longitudinally extending groove in a face of a first metallic member, (b) arranging at least one longitudinally extending metal coated fibre and at least one longitudinally extending metallic wire in the longitudinally extending groove in the first metallic member, (c) forming a longitudinally extending protection on a face of a second metallic member, (d) arranging the second metallic member such that the longitudinally extending projection of the second metallic member is aligned with the longitudinally extending groove of the first metallic member, (e) applying heat and pressure such that the longitudinal extending projection moves into the longitudinally extending groove to consolidate the at least one longitudinally extending metal coated fibre and the at least one longitudinally extending metallic wire and to bond the first metallic member, the second metallic member, the at least one longitudinally extending metal coated fibre and the at least one longitudinally extending metallic wire to form a unitary composite component, the method further comprising forming a circumferentially extending groove in an axial face of the first metallic member, arranging the at least one circumferentially extending metal coated fibre and at least one circumferentially extending metallic wire in the circumferentially extending groove in the first metallic member, forming a circumferentially extending projection on a face of the second metallic member, arranging the second metallic member such that the circumferentially extending projection of the second metallic member is aligned with the circumferentially extending groove of the first metallic member, applying heat and pressure such that the circumferentially extending protection moves into the circumferentially extending groove to consolidate the at least one circumferentially extending metal coated fibre and the circumferentially extending metallic wire and to bond the first metallic member, the second metallic member, the at least one circumferentially extending metal coated fibre and the circumferentially extending metallic wire to form a unitary composite component and arranging the at least one circumferentially extending metal coated fibre and the at least one circumferentially extending metallic wire in the circumferentially extending groove in the first metallic member such that the at least one circumferentially extending metal coated fibre and the at least one circumferentially extending metallic wire are arranged in different planes.

3. A method of manufacturing a fibre reinforced metal component comprising the steps of:

(a) forming a longitudinally extending groove in a face of a first metallic member, (b) arranging at least one longitudinally extending metal coated fibre and at least one longitudinally extending metallic wire in the longitudinally extending groove in the first metallic member, (c) forming a longitudinally extending projection on a face of a second metallic member, (d) arranging the second metallic member such that the longitudinally extending projection of the second metallic member is aligned with the longitudinally extending groove of the first metallic member, (e) applying heat and pressure such that the longitudinally extending projection moves into the longitudinally extending groove to consolidate the at least one longitudinally extending metal coated fibre and the at least one longitudinally extending metallic wire and to bond the first metallic member, the second metallic member, the at least one longitudinally extending metal coated fibre and the at least one longitudinally extending metallic wire to form a unitary composite component, the method further comprising forming a circumferentially extending groove in an axial face of the first metallic member, arranging the at least one circumferentially extending metal coated fibre and at least one circumferentially extending metallic wire in the circumferentially extending groove in the first metallic member, forming a circumferentially extending projection on a face of the second metallic member, arranging the second metallic member such that the circumferentially extending projection of the second metallic member is aligned with the circumferentially extending groove of the first metallic member, applying heat and pressure such that the circumferentially extending projection moves into the circumferentially extending groove to consolidate the at least one circumferentially extending metal coated fibre and the circumferentially extending metallic wire and to bond the first metallic member, the second metallic member, the at least one circumferentially extending metal coated fibre and the circumferentially extending metallic wire to form a unitary composite component and arranging a plurality of circumferentially extending metal coated fibres and a plurality of circumferentially extending metallic wires in the circumferentially extending groove in the first metallic member and arranging the plurality of circumferentially extending metal coated fibres and the plurality of circumferentially extending metallic wires in the circumferentially extending groove in the first metallic member such that a first one of the plurality of circumferentially extending metal coated fibres and a first one of the plurality of circumferentially extending metallic wires are arranged in a first common plane, a second one of the plurality of circumferentially extending metal coated fibres and a second one of the plurality of circumferentially extending metallic wires are arranged in a second common plane and the first and second common planes are spaced apart axially of the first metallic member.

4. A method of manufacturing a fibre reinforced metal component comprising the steps of:

(a) forming a longitudinally extending groove in a face of a first metallic member, (b) arranging at least one longitudinally extending metal coated fibre and at least one longitudinally extending metallic wire in the longitudinally extending groove in the first metallic member, (c) forming a longitudinally extending projection on a face of a second metallic member, (d) arranging the second metallic member such that the longitudinally extending projection of the second metallic member is aligned with the longitudinally extending groove of the first metallic member, (e) applying heat and pressure such that the longitudinally extending projection moves into the longitudinally extending groove to consolidate the at least one longitudinally extending metal coated fibre and the at least one longitudinally extending metallic wire and to bond the first metallic member, the second metallic member, the at least one longitudinally extending metal coated fibre and the at least one longitudinally extending metallic wire to form a unitary composite component and forming a circumferentially extending groove in an axial face of the first metallic member, arranging the at least one circumferentially extending metal coated fibre and at least one circumferentially extending metallic wire in the circumferentially extending groove in the first metallic member forming a circumferentially extending projection on a face of the second metallic member, arranging the second metallic member such that the circumferentially extending projection of the second metallic member is aligned with the circumferentially extending groove of the first metallic member, applying heat and pressure such that the circumferentially extending projection moves into the circumferentially extending groove to consolidate the at least one circumferentially extending metal coated fibre and the circumferentially extending metallic wire and to bond the first metallic member, the second metallic member, the at least one circumferentially extending metal coated fibre and the circumferentially extending metallic wire to form a unitary composite component wherein the at least one circumferentially extending metallic wire is arranged in a spiral.

5. A method as claimed in claim 1 comprising arranging the at least one circumferentially extending metallic wire at a greater radial distance than the at least one circumferentially extending metal coated fibre.

6. A method as claimed in claim 3 comprising arranging a third one of the plurality of circumferentially extending metallic wires in a third plane, and the third plane is arranged axially between the first and second common planes.

7. A method as claimed in claim 1, 2, 3 or 4 wherein the at least one metallic coated fibre is selected from the group comprising a titanium coated fibre, a titanium aluminide coated fibre, and a titanium alloy coated fibre.

8. A method as claimed in claim 1, 2, 3 or 4 wherein the metal of the at least one metallic coated fibre is a different metal to the metal of the at least one metallic wire.

9. A method as claimed in claim 1, 2, 3 or 4 wherein the diameter of the at least one metallic coated fibre is the same as the diameter of the at least one metallic wire.

10. A method as claimed in claim 1 wherein the diameter of the at least one metallic coated fibre is the same as the diameter of the at least one metallic wire.

11. A method as claimed in claim 1, 2, 3 or 4 wherein the at least one circumferentially extending metal coated fibre is arranged in a spiral.

12. A method as claimed in claim 3 comprising arranging the at least one circumferentially extending metallic wire at a greater radial distance than the at least one circumferentially extending metal coated fibre.

* * * * *